United States Patent [19]

Connolly

[11] 3,993,006

[45] Nov. 23, 1976

[54] STORE SECURITY SYSTEM

[75] Inventor: Timothy J. Connolly, Vallejo, Calif.

[73] Assignee: The Raymond Lee Organization, Inc., New York, N.Y. ; a part interest

[22] Filed: Jan. 27, 1975

[21] Appl. No.: 544,115

[52] U.S. Cl. ..... 109/1 R; 109/2

[51] Int. Cl.[2] ..... E05G 5/00

[58] Field of Search ..... 52/174; 109/1 R, 2, 109/9, 10, 21; 188/32; 256/1

[56] References Cited

UNITED STATES PATENTS

| | | | |
|---|---|---|---|
| 1,703,751 | 2/1929 | Runkles et al. | 109/9 |
| 2,874,819 | 2/1959 | Nutter | 256/1 |
| 3,429,082 | 2/1969 | Strickland et al. | 109/10 X |
| 3,459,280 | 8/1969 | Grimm | 188/32 |

OTHER PUBLICATIONS

Building News, July, 1937, p. 31.

*Primary Examiner*—Robert L. Wolfe
*Assistant Examiner*—David H. Corbin
*Attorney, Agent, or Firm*—Daniel Jay Tick

[57] ABSTRACT

A steel fence extends from a building housing a store and encloses a parking area extending from a wall of the building having a window and a door. The fence has gates therein. A cashier's booth is provided on the wall and oversees the fenced enclosure. A control device electrically connects the cashier's booth and the door and gates for remote control of the door and gates from the cashier's booth.

2 Claims, 4 Drawing Figures

STORE SECURITY SYSTEM

DESCRIPTION OF THE INVENTION

The present invention relates to a store security system. More particularly, the invention relates to a store security system for a store in a building.

Objects of the invention are to provide a store security system of simple structure, which is inexpensive in manufacture, installable with facility and convenience, controllable by a single person, which functions efficiently, effectively and reliably to discourage robbers and thieves and trap robbers and thieves during the perpetration of a crime. The store security system of the invention also discourages and essentially prevents the theft of shopping carts from a food store.

In order that the invention may be readily carried into effect, it will now be described with reference to the accompanying drawing, wherein.

Figure 1:
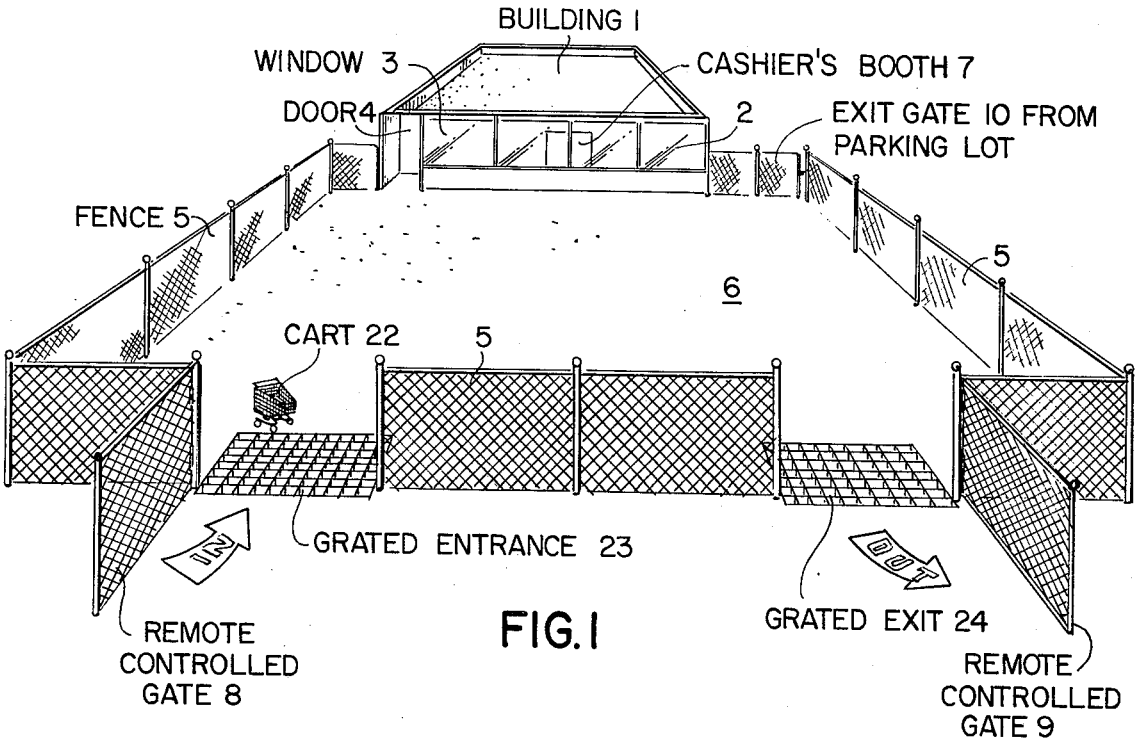
FIG. 1 is a perspective view of an embodiment of the store security system of the invention.

The store security system of the invention is for a store in a building 1 having a wall 2 with a window 3 and a door 4 therein, as shown in FIG. 1.

The store security system of the invention comprises a steel fence 5 extending from the building 1 and enclosing a parking area 6 extending from the wall 2 having the window and the door, as shown in FIG. 1.

As shown in FIG. 1, a cashier's booth 7 is provided on the wall 2 and oversees the fenced enclosure. The cashier's booth 7 is bulletproof and has a direct signal line to the nearest Police Station.

Figure 4:
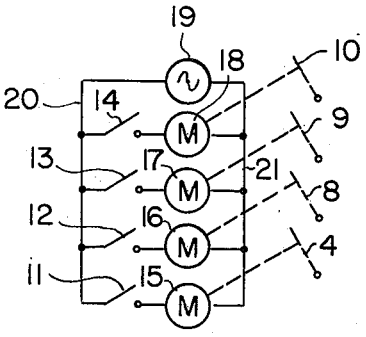
FIG. 4 is a circuit diagram of the store security system of the invention.

A control device electrically connects the cashier's booth 7 and the door 4 and gates 8, 9 and 10 (FIG. 1) of the fence for remote control of said door and said gates from the cashier's booth, as shown in FIG. 4. Thus, the control device may have a plurality of switches 11, 12, 13 and 14 provided therein in the cashier's booth 7. The switches 11, 12, 13 and 14 electrically connect motors 15, 16, 17 and 18, respectively, to a commercial power source 19 via an electrical circuit 20, 21. The motor 15 is coupled to and controls the opening and closing of the door 4. The motors 16, 17, and 18 are coupled to, and control the opening and closing of, the gates 8, 9 and 10, respectively.

Figure 2:
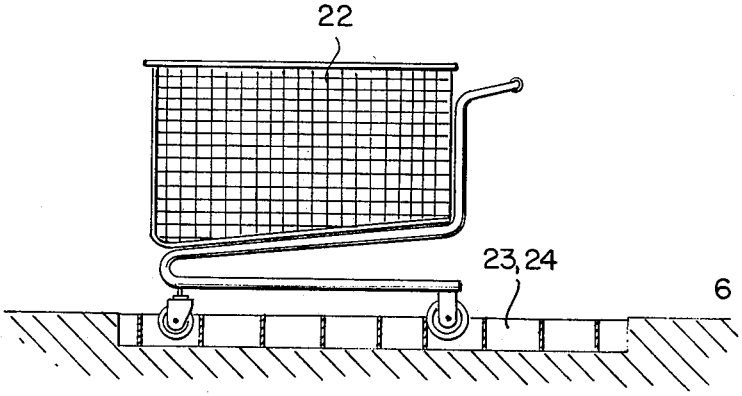
FIG. 2 is a view of a grated entrance or exit of the store security system of the invention in operation preventing the theft of a shopping cart.
Figure 3:
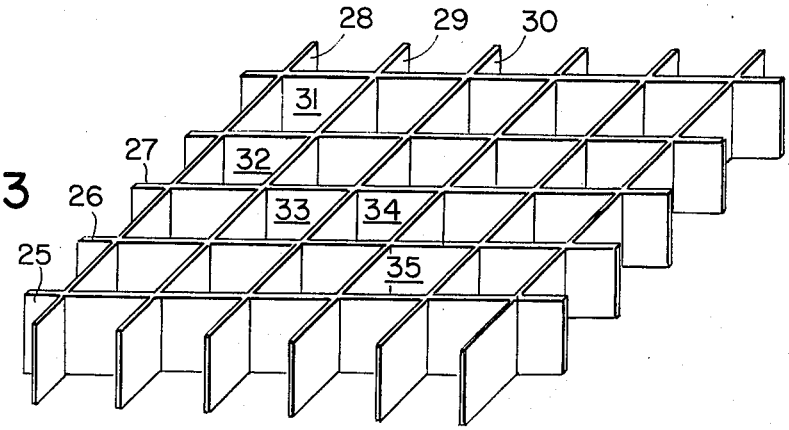
FIG. 3 is a perspective view of a grated entrance or exit of the store security system of the invention.

In order to discourage, and essentially prevent, the theft of shopping carts, such as, for example, the cart 22 (FIGS. 1 and 2), a grated entrance roadway 23 and a grated exit roadway 24 (FIG. 1) are provided at each gate 8 and 9 of the fence 5. As shown in FIGS. 2 and 3, the grated roadway prevents shopping carts from being wheeled thereover. As shown in FIG. 3, the grated roadway comprises a matrix arrangement of plate-like strips 25, 26, 27, 28, 29, 30, and so on, affixed to each other in substantially vertical position with corresponding edges thereof intersecting each other in spaced relation at substantially right angles in a horizontal plane and forming a roadway. The spaces 31, 32, 33, 34, 35, and so on, between the strips are larger in dimension than the wheels of the shopping carts, so that when such wheels slip into such spaces, the carts cannot be wheeled through the gate, as shown in FIG. 2.

While the invention has been described by means of a specific example and in a specific embodiment, I do not wish to be limited thereto, for obvious modifications will occur to those skilled in the art without departing from the spirit and scope of the invention.

I claim:

1. A store security system for a store in a building having a wall with a window and a door therein, said security system comprising.

a steel fence extending from the building and enclosing a parking area extending from the wall having the window and the door, said fence having gates therein;

a bulletproof cashier's booth on the wall overseeing the fenced enclosure;

control means electrically connecting the cashier's booth and the door and gates for remote control of the door and gates from the cashier's booth;

a direct signal line from the booth to a Police Station; and cart holding means at the gate for discouraging the theft of shopping carts.

2. A store security system as claimed in claim 1, wherein the cart hold means comprises a grated roadway at each gate of the fence for preventing shopping carts from being wheeled thereover, said grated roadway comprising a matrix arrangement of plate-like strips affixed to each other in substantially vertical position with corresponding edges thereof intersecting each other in spaced relation at substantially right angles in a horizontal plane and forming a roadway, the spaces between the strips being larger in dimension than wheels of shopping carts.

* * * * *